US011402161B2

(12) United States Patent
Houfuku

(10) Patent No.: US 11,402,161 B2
(45) Date of Patent: Aug. 2, 2022

(54) DISTRIBUTOR, HEAT EXCHANGER, INDOOR UNIT, OUTDOOR UNIT, AND AIR-CONDITIONING DEVICE

(71) Applicant: HITACHI-JOHNSON CONTROLS AIR CONDITIONING, INC., Tokyo (JP)

(72) Inventor: Mamoru Houfuku, Tokyo (JP)

(73) Assignee: HITACHI-JOHNSON CONTROLS AIR CONDITIONING, INC., Tokyo (JP)

( * ) Notice: Subject to any disclaimer, the term of this patent is extended or adjusted under 35 U.S.C. 154(b) by 107 days.

(21) Appl. No.: 16/782,348

(22) Filed: Feb. 5, 2020

(65) Prior Publication Data

US 2020/0333090 A1 Oct. 22, 2020

(30) Foreign Application Priority Data

Apr. 22, 2019 (JP) ..... JP2019-080765

(51) Int. Cl.
*F28F 9/02* (2006.01)
*F28D 1/04* (2006.01)

(52) U.S. Cl.
CPC ..... *F28F 9/0204* (2013.01); *F28D 1/0426* (2013.01)

(58) Field of Classification Search
CPC ..... F25B 39/028; F24F 1/0025; F24F 1/0059–0067; F28F 9/0278; F28F 9/028; F28F 9/0204
See application file for complete search history.

(56) References Cited

U.S. PATENT DOCUMENTS

2016/0238322 A1* 8/2016 Inoue ..... F28F 9/027
2017/0292741 A1* 10/2017 Inoue ..... F25B 13/00
2019/0257594 A1* 8/2019 Inoue ..... F28F 9/0263

FOREIGN PATENT DOCUMENTS

JP 2010139166 A * 6/2010
JP 2015-068623 A 4/2015
JP 2017-141999 A 8/2017
WO WO-2018062519 A1 * 4/2018 ..... F28D 1/05325

* cited by examiner

*Primary Examiner* — Eric S Ruppert
(74) *Attorney, Agent, or Firm* — Mattingly & Malur, PC

(57) ABSTRACT

A distributor distributing refrigerant to multiple pipes including a tubular member including, at a side surface thereof, multiple insertion ports into which the multiple pipes are inserted and a supply port through which the refrigerant is supplied, a first closing member and a second closing member configured to close the tubular member at two spots positioned along a longitudinal direction of the tubular member, and a partition member extending from the first closing member to the second closing member and configured to divide an internal space of the tubular member into a space on an insertion port side and a space on a supply port side. The partition member includes two protruding portions contacting tip ends of the multiple pipes, and includes a refrigerant flow path between the two protruding portions on a first closing member side of one of the insertion ports closest to the first closing member.

10 Claims, 9 Drawing Sheets

| | REFRIGERANT FLOW RATE 10kg/h | | REFRIGERANT FLOW RATE 5kg/h | |
|---|---|---|---|---|
| | FIRST TIME | SECOND TIME | FIRST TIME | SECOND TIME |
| WITHOUT PARTITION MEMBER | 56% | 59% | 44% | 88% |
| WITH PARTITION MEMBER | 11% | 19% | 8% | 23% |

DISTRIBUTOR, HEAT EXCHANGER, INDOOR UNIT, OUTDOOR UNIT, AND AIR-CONDITIONING DEVICE

CROSS-REFERENCE TO RELATED APPLICATION

This application claims priority from Japanese Patent Application No. 2019-080765 filed with the Japan Patent Office on Apr. 22, 2019, the entire content of which is hereby incorporated by reference.

BACKGROUND

1. Technical Field

The present disclosure relates to a distributor, a heat exchanger, an indoor unit, an outdoor unit, and an air-conditioning device.

2. Related Art

A distributor configured to distribute refrigerant to multiple pipes, a heat exchanger including the distributor, indoor and outdoor units including the heat exchangers, and an air-conditioning device including the indoor unit and the outdoor unit have been known.

The air-conditioning device is configured such that the refrigerant circulates between the indoor unit and the outdoor unit. Then, heat is exchanged between the refrigerant and air. Accordingly, the inside of a room is cooled or heated. Thus, the indoor unit and the outdoor unit have the heat exchangers. Of these heat exchangers, one heat exchanger is used as a refrigerant evaporator. For example, a flat pipe heat exchanger having a high heat exchange efficiency and having headers at both ends is used as the heat exchanger.

In the case of using the flat pipe heat exchanger as the evaporator, the refrigerant is in two phases of gas and liquid in the header on a refrigerant inlet side. A density difference between the gas and the liquid is great, and therefore, it is difficult to distribute the refrigerant to each heat transfer pipe such that the volumes of the gas and the liquid are equalized. For this reason, in some cases, the heat transfer area of the heat exchanger cannot be effectively utilized. As a result, a problem that the energy efficiency of the air-conditioning device is degraded is caused.

For this reason, the technique of decreasing the sectional area of a refrigerant flow path of a lower portion into which a flat pipe is inserted as compared to the sectional area of a refrigerant flow path of an upper portion to which a bypass pipe is connected has been proposed. With this technique, a circulating flow is easily caused. Thus, it is expected that the refrigerant is substantially equally distributed. Moreover, the technique of providing an upper communication path and a lower communication path in two internal spaces of the header divided by the partition member has been also known. It is expected that a refrigerant drift is reduced by circulation of the gas-liquid two-phase refrigerant in these paths (see, e.g., JP-A-2017-141999 and JP-A-2015-68623).

SUMMARY

A distributor according to an embodiment of the present disclosure is a distributor for distributing refrigerant to multiple pipes, including: a tubular member including, at a side surface thereof, multiple insertion ports into which the multiple pipes are inserted and a supply port through which the refrigerant is supplied; a first closing member and a second closing member configured to close the tubular member at two spots positioned along a longitudinal direction of the tubular member; and a partition member extending from the first closing member to the second closing member and configured to divide an internal space of the tubular member into a space on an insertion port side and a space on a supply port side. The partition member includes two protruding portions contacting tip ends of the multiple pipes inserted into the multiple insertion ports, and includes a refrigerant flow path between the two protruding portions on a first closing member side of one of the insertion ports closest to the first closing member.

DETAILED DESCRIPTION

Figure 1:
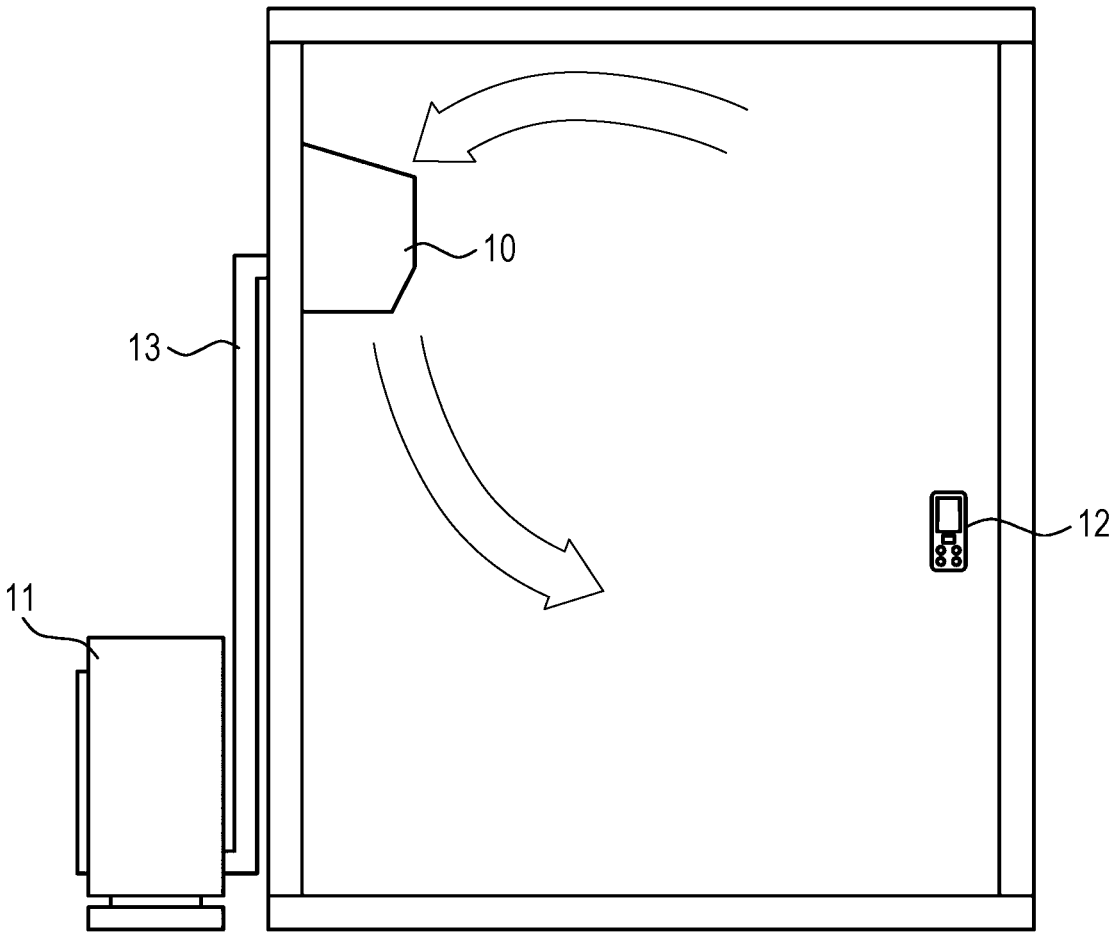
FIG. 1 is a view of a configuration example of an air-conditioning device.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In the technique described in JP-A-2017-141999, in the case of a low operation load, a sufficient drawing effect is not provided in some cases. In this case, a problem that the drift is not improved due to dropping of the liquid refrigerant in the header is caused.

Moreover, in the technique described in JP-A-2015-68623, even in the case of a low operation load, the drift can be reduced. However, the refrigerant needs to be circulated, and for this reason, a structure is complicated. Moreover, an inflow portion needs to be provided in the header on a lower side of the flat pipe. For this reason, the number of members increases, and a problem that a product cannot be provided at low cost is caused.

In view of the above problems, the present disclosure provides a distributor for distributing refrigerant to multiple pipes, including: a tubular member including, at a side surface thereof, multiple insertion ports into which the multiple pipes are inserted and a supply port through which the refrigerant is supplied; a first closing member and a second closing member configured to close the tubular member at two spots positioned along a longitudinal direction of the tubular member; and a partition member extending from the first closing member to the second closing member and configured to divide an internal space of the tubular member into a space on an insertion port side and a space on a supply port side. The partition member includes two protruding portions contacting tip ends of the multiple pipes inserted into the multiple insertion ports, and includes a refrigerant flow path between the two protruding portions on a first closing member side of one of the insertion ports closest to the first closing member.

According to the present embodiment, even in the case of a low operation load, a refrigerant drift can be improved. Thus, a product having a simple structure can be provided at low cost.

FIG. 1 is a view of a configuration example of an air-conditioning device. The air-conditioning device includes one or more indoor units provided in the same space and one or more outdoor units placed outside such a space. Moreover, the air-conditioning device includes a remote controller to be operated by a user.

The device illustrated as an example in FIG. 1 includes a single indoor unit 10 placed inside a room, a single outdoor unit 11 placed outside the room, and a single remote controller 12 for operating the indoor unit 10.

The indoor unit 10 and the outdoor unit 11 are connected to each other through two pipes 13, and are configured such that refrigerant circulates in the pipes 13. The refrigerant is a heat medium used for moving heat. Examples of the refrigerant to be used include hydrofluorocarbon (HFC) or hydrofluoroolefin (HFO).

The remote controller 12 has various input buttons such as a power button and a temperature setting button. The remote controller 12 communicates with the indoor unit 10. The remote controller 12 receives input from the user, thereby instructing the indoor unit 10 to start or stop operation or notifying the indoor unit 10 of information such as a set temperature. The indoor unit 10 and the outdoor unit 11 are connected to each other through, e.g., a communication cable. Thus, the indoor unit 10 and the outdoor unit 11 communicate with each other. By such communication, the indoor unit 10 instructs the outdoor unit 11 to start or stop operation, or notifies the outdoor unit 11 of information such as an indoor temperature and the set temperature. In response to the instruction from the indoor unit 10, the outdoor unit 11 starts or stops operation. Further, the outdoor unit 11 acquires the information from the indoor unit 10, thereby changing an operation load such that the indoor temperature approaches the set temperature.

Figure 2A:
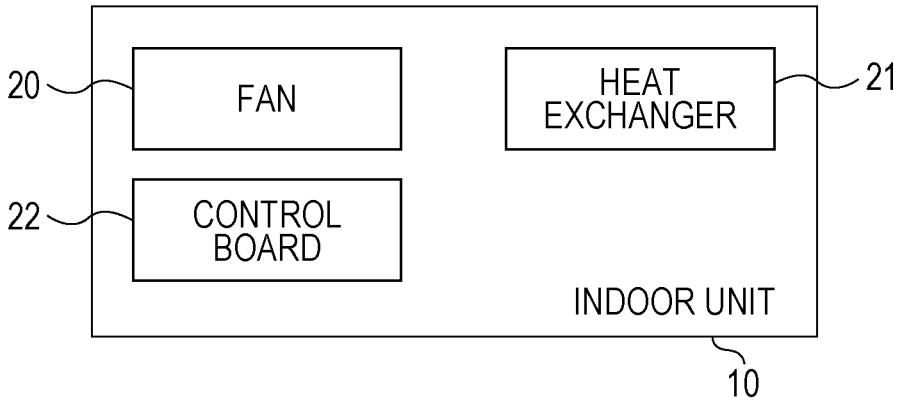
FIGS. 2A and 2B are views of configuration examples of an indoor unit and an outdoor unit.
Figure 2B:
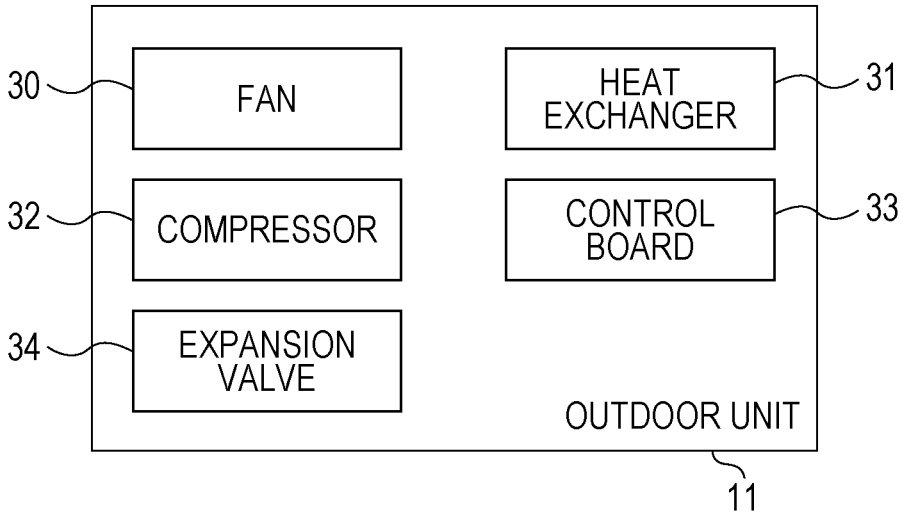

FIGS. 2A and 2B are diagrams of configuration examples of the indoor unit 10 and the outdoor unit 11. FIG. 2A illustrates the configuration example of the indoor unit 10. FIG. 2B illustrates the configuration example of the outdoor unit 11.

The indoor unit 10 includes a fan 20 configured to suck air from the room or blow air into the room, a heat exchanger 21 configured to heat or cool the sucked air, and a control board 22 configured to control the indoor unit 10. The indoor unit 10 may include, for example, a temperature sensor configured to measure the indoor temperature and a humidity sensor configured to measure an indoor humidity.

The control board 22 communicates with the remote controller 12 operated by the user. Moreover, in response to an instruction from the remote controller 12, the control board 22 operates or stops the indoor unit 10, or sets or changes an operation mode, a temperature, a humidity, an air volume, and the like. Further, the control board 22 notifies the outdoor unit 11 of information measured by the temperature sensor and the like, such as the indoor temperature and the set temperature. In addition, the control board 22 controls the fan 20 to adjust the air volume such that the set temperature or a set air volume is achieved.

The outdoor unit 11 includes a fan 30 configured to suck external air or blow air, a heat exchanger 31 configured to heat or cool the sucked air, a compressor 32 configured to circulate the refrigerant between the indoor unit 10 and the outdoor unit 11, a control board 33 configured to control the outdoor unit 11, and an expansion valve 34. The outdoor unit 11 may include, for example, a temperature sensor configured to measure an external air temperature, a sensor configured to measure a current supplied to the compressor 32, a sensor configured to measure a refrigerant flow rate, a sensor configured to measure a refrigerant pressure, a four-way valve, and an accumulator.

In response to the instruction from the indoor unit 10, the control board 33 operates or stops the outdoor unit 11. Moreover, based on the notified information, the control board 33 controls the fan 30 and the compressor 32 to change the operation load such that the indoor temperature reaches the set temperature. In this manner, the control board 33 adjusts, for example, the temperature of refrigerant supplied to the indoor unit 10 or the flow rate of circulating refrigerant. The expansion valve 34 is used for expanding the compressed refrigerant to decrease the refrigerant temperature.

Figure 3B:
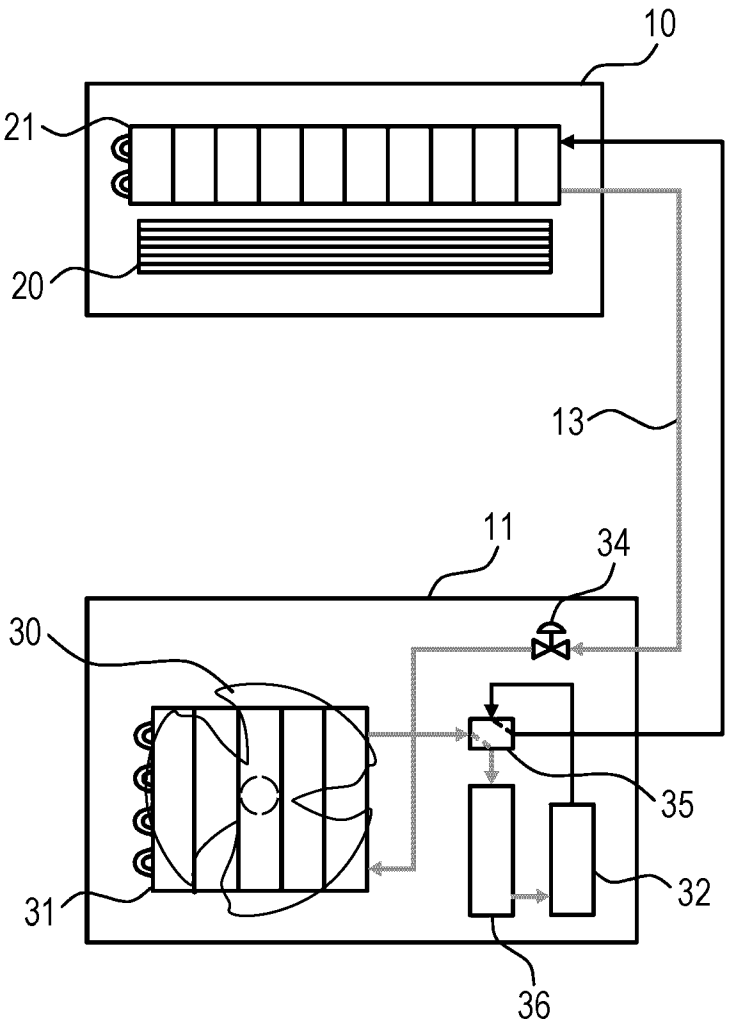
FIGS. 3A and 3B are views for describing operation of the indoor unit and the outdoor unit.
Figure 3A:
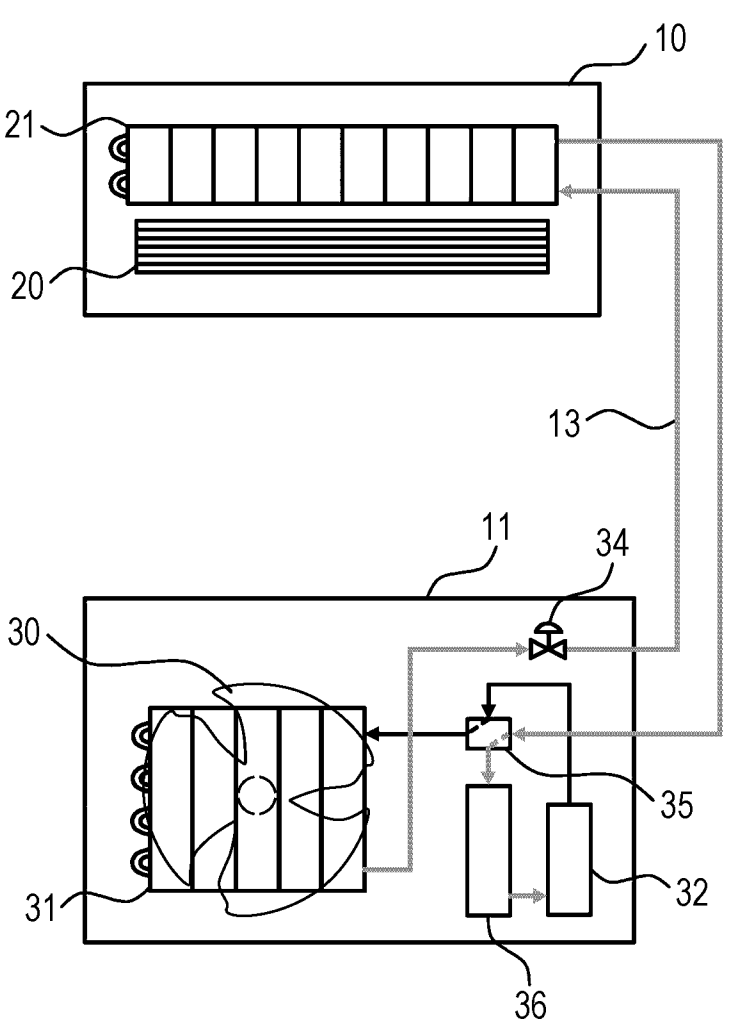

Operation of the indoor unit 10 and the outdoor unit 11 in the operating air-conditioning device will be briefly described with reference to FIGS. 3A and 3B. When operation of the outdoor unit 11 begins, the compressor 32 is started to start refrigerant circulation between the indoor unit 10 and the outdoor unit 11.

A case where the air-conditioning device is used for air-cooling will be described with reference to FIG. 3A. The compressor 32 compresses and discharges the refrigerant. Then, the high-temperature high-pressure refrigerant is supplied into the heat exchanger 31 through a four-way valve 35. The refrigerant is cooled by heat exchange with the external air sucked by the fan 30. After cooling, the refrigerant is expanded by the expansion valve 34. Accordingly, the refrigerant temperature decreases. Further, at least part of the refrigerant is evaporated. Thus, the refrigerant in a gas-liquid two-phase state is sent from the outdoor unit 11 to the indoor unit 10 through the pipe 13.

In the indoor unit 10, the refrigerant supplied into the heat exchanger 21 exchanges heat with the indoor air sucked by the fan 20. The indoor air is cooled by the refrigerant, and is blown into the room.

The refrigerant takes heat from the air in the heat exchanger 21, and is converted into gas. The refrigerant passes through the pipe 13, and enters an accumulator 36 through the four-way valve 35. In the accumulator 36, the liquid refrigerant which has not been converted into gas in the heat exchanger 21 is separated. In this manner, only the gaseous refrigerant returns to the compressor 32. By repeating such operation, the inside of the room is cooled by the blown cold air until the indoor temperature reaches the set temperature.

A case where the air-conditioning device is used for air-heating will be described with reference to FIG. 3B. In the case of air-heating, operation is performed in a manner opposite to that of the case of air-cooling. By switching the four-way valve 35, a refrigerant flow becomes opposite to that of the case of air-cooling. The compressor 32 adiabatically compresses the gaseous refrigerant. Then, the compressor 32 discharges the high-temperature high-pressure refrigerant. The refrigerant is not sent to the heat exchanger 31 through the four-way valve 35, but is sent to the indoor unit 10 through the pipe 13 by way of the four-way valve 35. In the indoor unit 10, the refrigerant supplied into the heat exchanger 21 exchanges heat with the indoor air sucked by the fan 20. The air is heated by the refrigerant, and is blown into the room.

The refrigerant provides heat to the air in the heat exchanger 21, and is cooled. Accordingly, at least part of the refrigerant is condensed. The refrigerant is sent to the outdoor unit 11 through the pipe 13. In the outdoor unit 11, the condensed high-pressure refrigerant is expanded by the expansion valve 34. Accordingly, the refrigerant turns into a low-temperature low-pressure state. Thereafter, the refrigerant supplied into the heat exchanger 31 exchanges heat with the external air sucked by the fan 30, and is converted into gas. The refrigerant returns to the compressor 32 through the four-way valve 35 and the accumulator 36. By repeating such operation, the inside of the room is heated by the blown hot air such that the indoor temperature reaches the set temperature.

Figure 4:
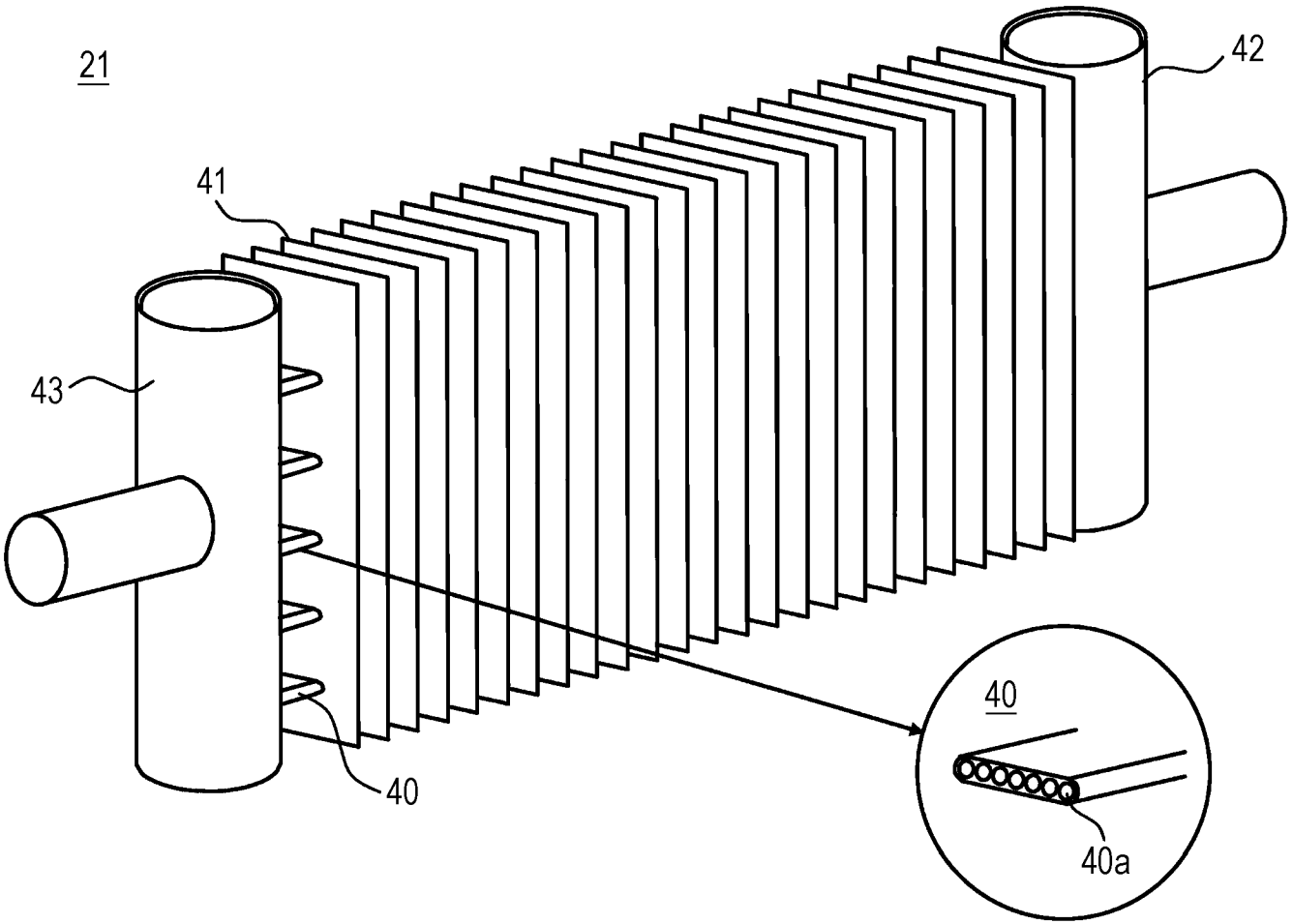
FIG. 4 is a view of one example of a heat exchanger included in the indoor unit and the outdoor unit.

One example of the heat exchangers 21, 31 used in the indoor unit 10 and the outdoor unit 11 as illustrated in FIGS. 2A and 2B is illustrated in FIG. 4. The same heat exchanger can be used as the heat exchangers 21, 31. Thus, only the heat exchanger 21 will be described here.

The heat exchanger 21 includes multiple pipes, plate-shaped members (fins) 41 attached to outer surfaces of the multiple pipes, and distributors (headers) 42, 43 provided at both ends of each of the multiple pipes. The headers 42, 43 distribute the refrigerant to the multiple pipes, and cause the distributed refrigerant to join together. The heat exchanger 21 in this figure is a parallel flow type heat exchanger. This heat exchanger includes multiple pipes extending in parallel with each other. The refrigerant flows in one direction in these pipes.

The pipe may be a circular pipe having a single hole. Note that as illustrated in close-up in FIG. 4, the pipe is preferably a flat pipe 40 formed in a flat shape and having multiple holes 40*a*. With this configuration, a heat transfer area in the pipe increases. As a result, the length of contact between the pipe and the fin 41 increases. Thus, a fin efficiency is improved. Moreover, by joining by brazing connection, heat resistance can be decreased. Hereinafter, the heat exchanger 21 will be described assuming that the pipe is the flat pipe 40.

The flat pipes 40 are arranged at certain intervals in one direction. In such a direction, the multiple fins 41 in parallel are joined to the flat pipes 40 at certain intervals. The multiple fins 41 expand the heat transfer area, and increase a heat transfer amount.

The header 42 is connected to one of two pipes 13. For example, the header 42 distributes the refrigerant supplied from the pipe 13 to the multiple flat pipes 40. The header 43 is connected to the remaining pipe 13. For example, the header 43 causes the refrigerant distributed to the multiple flat pipes 40 to join together, and further sends out the joined refrigerant.

The refrigerant moves from the header 42 to the header 43 through the multiple holes 40*a* in the multiple flat pipes 40. Air moves between adjacent ones of the fins 41. The refrigerant and the air exchange heat with each other through pipe walls of the flat pipes 40 and the fins 41.

Thus, the flat pipe 40 and the fin 41 are preferably made of a material having a high heat conductivity. Examples of the material having the high heat conductivity include a carbon nanotube, gold, silver, copper, aluminum, and aluminum alloy.

Figure 5:
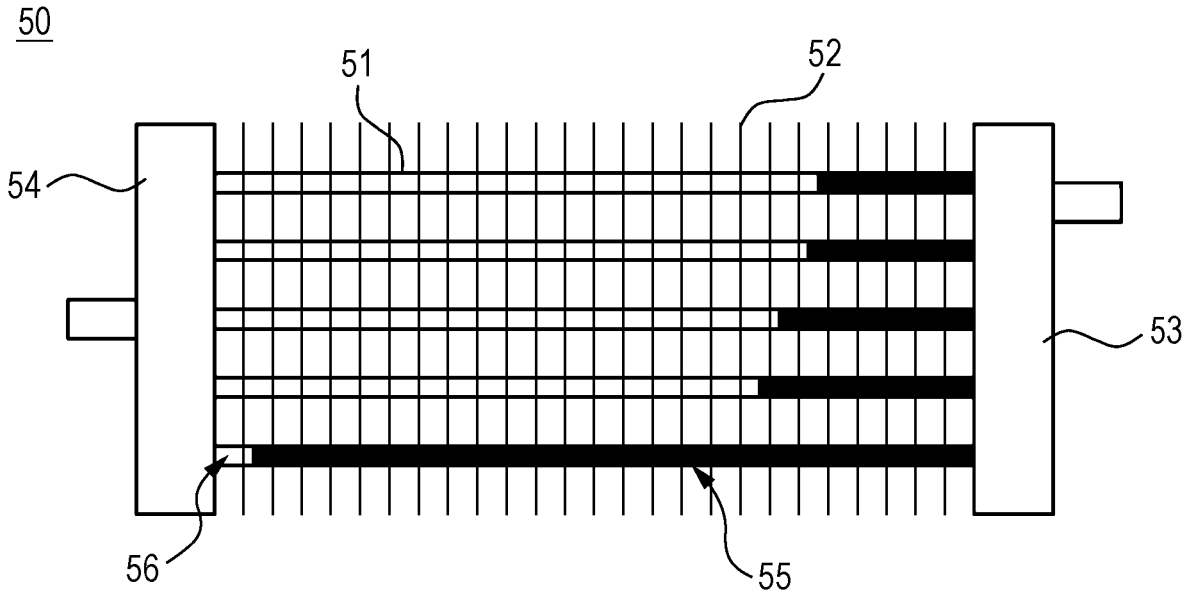
FIG. 5 is a view for describing a drift caused in the heat exchanger.

A drift caused in a heat exchanger 50 in the case of using the heat exchanger 50 as an evaporator will be described with reference to FIG. 5. As in the heat exchanger 21 illustrated in FIG. 4, the heat exchanger 50 includes multiple flat pipes 51, multiple fins 52, and headers 53, 54. The refrigerant is supplied to the header 53 in this case. Subsequently, the refrigerant is distributed to each flat pipe 51 by the header 53. The distributed refrigerant moves toward the header 54, and joins together at the header 54. Then, the refrigerant is sent out of the header 54.

The refrigerant supplied to the header 53 is in a gas-liquid two-phase state including a mixture of gas and liquid. FIG. 5 illustrates a state in which the refrigerant is distributed to each flat pipe 51 by the header 53 and flows in each flat pipe 51. In FIG. 5, black portions 55 in the flat pipes 51 indicate the refrigerant in the gas-liquid two-phase state. Moreover, white portions 56 indicate the refrigerant in a gaseous state.

Liquid has a greater density as compared to gas. Thus, in a case where the inside of the headers 53, 54 is a cavity, the liquid is collected to a lower side in the headers 53, 54 due to the force of gravity. As a result, more refrigerant in the gas-liquid two-phase state flows into the lower flat pipes 51. In an example illustrated in FIG. 5, the lowermost flat pipe 51 of the flat pipes 51 arranged in five tiers are almost entirely blackened. In other flat pipes 51, the amount of refrigerant in the gas-liquid two-phase state is small. As a result, an uneven refrigerant flow (the drift) is caused.

The drift caused as described above degrades the heat exchange efficiency of the heat exchanger 50. Thus, the header 53 configured to equally distribute the refrigerant to the multiple flat pipes is necessary to prevent occurrence of the drift.

Figure 6A:
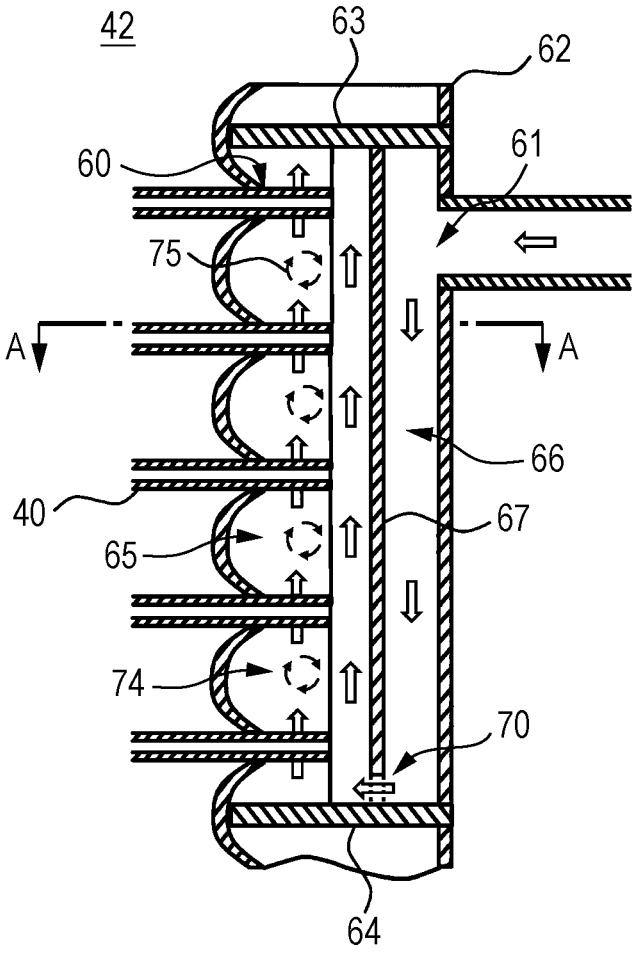
FIGS. 6A and 6B are views of a first example of a distributor provided at the heat exchanger.
Figure 6B:
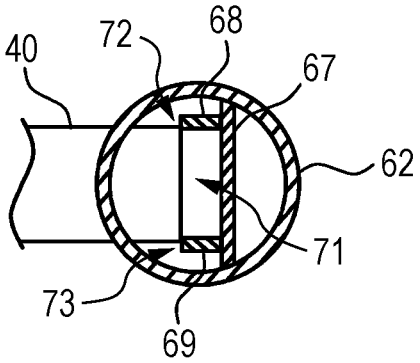

FIGS. 6A and 6B are views of a first configuration example of the header. FIG. 6A is a sectional view of the header in a longitudinal direction thereof. FIG. 6B is a sectional view in an A-A direction of a cut line of FIG. 6A. The header used as the evaporator is the header 42 on a refrigerant inlet side. The header 42 includes, at a side surface thereof, a tubular member 62 and closing members 63, 64 configured to close the tubular member 62 at two spots positioned along a longitudinal direction of the tubular member 62. The tubular member 62 includes, at a side surface thereof, multiple insertion ports 60 into which the multiple flat pipes 40 are inserted and a supply port 61 through which the refrigerant is supplied. The tubular member 62 is, for example, a pipe having a circular section. In this case, the closing members 63, 64 are, for example, substantially-discoid lids configured to close the inside of the tubular member 62. Note that as long as the tubular member 62 is a tubular member, the tubular member 62 is not limited to the pipe. For example, the tubular member 62 may be a member having a rectangular section defined by two members having backwards C-shaped sections. Alternatively, the tubular member 62 may be a pipe having an oval section. Hereinafter, the header 42 will be described assuming that a position at which the closing member (a second closing member) 63 is provided is on an upper side and a position at which the closing member (a first closing member) 64 is provided is on a lower side.

As illustrated in FIG. 6A, the header 42 extends from the upper closing member 63 to the lower closing member 64. The tubular member 62 includes a partition member 67. The partition member 67 divides an internal space of the tubular member 62 into a space 65 on the side of the multiple insertion ports 60 and a space 66 on a supply port 61 side. The partition member 67 extends from the upper closing member 63 to the lower closing member 64. As illustrated in FIG. 6B, the partition member 67 includes two protruding portions 68, 69. The protruding portions 68, 69 contact tip ends of the multiple flat pipes 40 inserted into the multiple insertion ports 60. Moreover, as illustrated in FIG. 6A, the partition member 67 has a flow path 70 of refrigerant circulation between two protruding portions 68, 69 on the lower side (a closing member 64 side) of the lowermost insertion port 60.

The flat pipes 40 are inserted into the tubular member 62. Thus, the insertion ports 60 are at inwardly-recessed positions. Thus, a side portion of the section of the tubular member 62 has an arc shape sandwiching the flat pipes 40.

The refrigerant in the gas-liquid two-phase state is supplied from the supply port 61. The refrigerant passes through the space 66 defined by the partition member 67. Then, the refrigerant flows downward due to influence of the force of gravity. The refrigerant enters the space 65 through the flow path 70. Thereafter, the refrigerant flows from the lower side to the upper side in the space 65. In the space 65, part of the section of a flow path in which the refrigerant flows is closed by the inserted flat pipes 40. Moreover, two protruding portions 68, 69 contact the tip ends of the flat pipes 40. Thus, as illustrated in FIG. 6B, three flow paths 71 to 73 are defined. At two points most apart from each other at the tip end of each flat pipe 40, two protruding portions 68, 69 contact the flat pipes 40 not to close holes of the flat pipes 40.

The section of the first flow path 71 is defined by two protruding portions 68, 69, a main body (a flat plate portion other than two protruding portions 68, 69) of the partition member 67, and the tip ends of the multiple flat pipes 40. The first flow path 71 includes a region continuing from the lower closing member 64 to the upper closing member 63. The section of the second flow path 72 is defined by the tubular member 62, side portions of the flat pipes 40 inserted into the tubular member 62, and the protruding portion 68. The second flow path 72 includes a region continuing from the lower closing member 64 to the upper closing member 63. The section of the third flow path 73 is defined by the tubular member 62, the side portions of the flat pipes 40 inserted into the tubular member 62, and the protruding portion 69. The third flow path 73 includes a region continuing from the lower closing member 64 to the upper closing member 63.

The sectional area of the second flow path 72 and the sectional area of the third flow path 73 are substantially the same as each other. The sectional areas of the first flow path 71, the second flow path 72, and the third flow path 73 are changed according to the protruding lengths of two protruding portions 68, 69. The sectional area relates to a refrigerant flow velocity. As the flow velocity increases, the refrigerant in the gas-liquid two-phase state more easily flows in the flow path without complete separation of gas and liquid.

Thus, the sectional area of the first flow path 71 can be larger than the total of the sectional area of the second flow path 72 and the sectional area of the third flow path 73. With this configuration, the refrigerant flow velocity is high in the second flow path 72 and the third flow path 73. Thus, the refrigerant in the gas-liquid two-phase state flows in the second flow path 72 and the third flow path 73. Accordingly, the refrigerant in the gas-liquid two-phase state can be supplied to the first flow path 71 from both of the upper and lower sides. As a result, the refrigerant in the gas-liquid two-phase state equally flows in any flat pipe 40. Consequently, the refrigerant drift can be improved.

Note that in the space 65, a space 74 is present in other regions than the first flow path 71, the second flow path 72, and the third flow path 73, i.e., between adjacent ones of the flat pipes 40 arranged vertically. The accumulated refrigerant is pushed out by the refrigerant flowing into the spaces 74 and having different flow velocities, and flows out to each flow path. Such a process is repeated. Accordingly, an eddy 75 is caused in each space 74 as illustrated in FIG. 6A. Separation of gas and liquid is reduced by a refrigerant agitating effect obtained as described above.

Operation conditions of the air-conditioning device include a rated load condition and an intermediate load condition. The rated load condition is a condition in operation with the maximum load satisfied by specifications. The intermediate load condition is a condition in operation with a load smaller than a rated load. The intermediate load condition is, for example, a condition in operation with a load of 50% of the rated load. Note that the operation conditions are not limited to the rated load condition and the intermediate load condition. The operation conditions may include other conditions such as a minimum load condition. The load conditions include a condition such as a refrigerant circulation amount, and are determined substantially in proportion to the load.

Thus, under a condition where the refrigerant circulation amount is small, such as the intermediate load condition, the refrigerant flow velocity in the header is low in a case where the inside of the header is merely a cavity and the refrigerant is supplied from the lower side. For this reason, the refrigerant less reaches the upper closing member.

The inside of the header 42 illustrated in FIGS. 6A and 6B is partitioned by the partition member 67. Further, the refrigerant is supplied from the upper side of the header 42. Thus, even when the refrigerant circulation amount decreases, the refrigerant can be accelerated due to the influence of the force of gravity. Moreover, part of the section of the flow path in which the refrigerant flows from the lower side to the upper side is closed by the inserted flat pipes 40. Thus, the sectional area of the refrigerant flow path is small. Consequently, even when the refrigerant circulation amount is small as in, e.g., the intermediate load condition, the refrigerant can reach the upper closing member 63 at a flow velocity equal to or higher than a certain velocity. As a result, the refrigerant drift can be improved.

The structure of the header 42 on the refrigerant inlet side has been described here. The header 43 on an outlet side may be a header having the multiple inserted flat pipes 40 and the inside of the cavity. Alternatively, the header 43 on the outlet side may be a header having the same structure as that of the header 42.

Figure 7A:
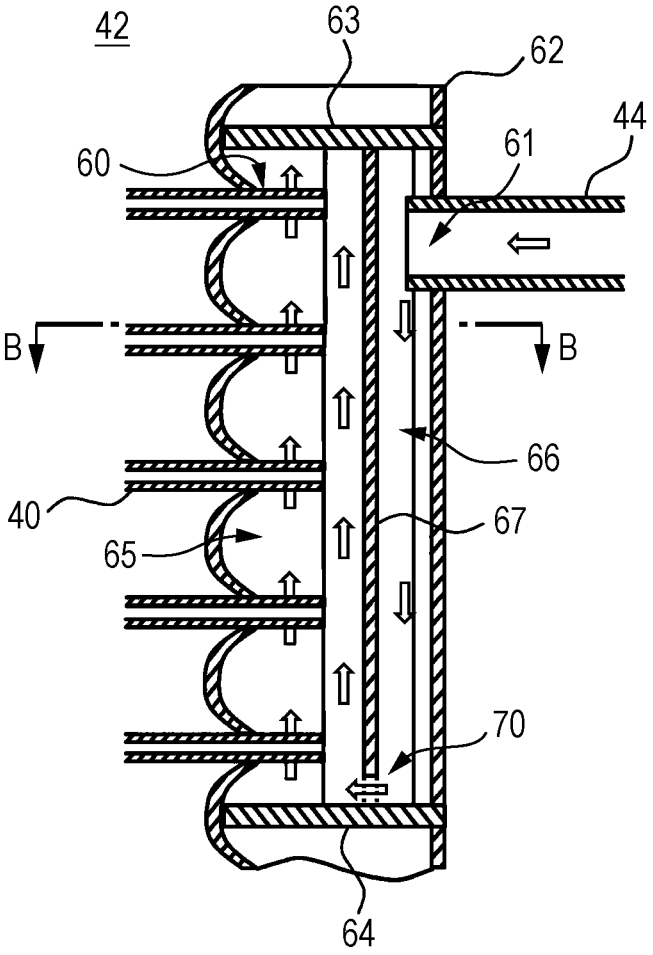
FIGS. 7A and 7B are views of a second example of the distributor provided at the heat exchanger.
Figure 7B:
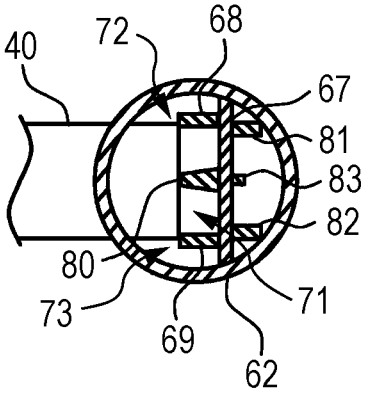

FIGS. 7A and 7B are views of a second configuration example of the header. FIG. 7A is a sectional view of the header in the longitudinal direction thereof. FIG. 7B is a sectional view in a B-B direction of a cut line of FIG. 7A. As in the example illustrated in FIGS. 6A and 6B, the header 42 includes the tubular member 62 and the closing members 63, 64. The tubular member 62 includes the multiple insertion ports 60 and the supply port 61. The closing members 63, 64 close the tubular member 62 at two spots positioned along the longitudinal direction of the tubular member 62.

As in the example illustrated in FIGS. 6A and 6B, the header 42 includes the partition member 67. The partition member 67 divides the internal space of the tubular member 62 into the space 65 on the side of the multiple insertion ports 60 and the space 66 on the supply port 61 side. The partition member 67 includes two protruding portions 68, 69. The protruding portions 68, 69 contact the tip ends of the multiple flat pipes 40 inserted into the multiple insertion ports 60. Moreover, the partition member 67 has the flow path 70 between two protruding portions 68, 69 on the lower side of the lowermost insertion port 60. These configurations have been already described with reference to FIGS. 6A and 6B. For this reason, further description will be omitted here.

In addition to two protruding portions 68, 69 contacting two points of the tip end of each inserted flat pipe 40, the partition member 67 includes multiple protrusions 80 between two protruding portions 68, 69. The protrusion 80 contacts the tip end of each flat pipe 40 not to close the hole of each flat pipe 40.

Each flat pipe 40 contacts two protruding portions 68, 69. With this configuration, positioning of the flat pipes 40 in an insertion direction thereof can be performed. However, positioning according to two points contacting at the same height is not stable because the flat pipe 40 inclines vertically. For this reason, the protrusion 80 is provided at a position different from the above-described two points in the height. With this configuration, vertical inclination of the flat pipe 40 is reduced. Thus, positioning is stabilized. The protrusion 80 can be, for example, provided to contact the flat pipe 40 at a single point of the tip end of the flat pipe 40 positioned on the upper side of a line connecting two protruding portions 68, 69. Note that this is one example. The protrusion 80 may contact the flat pipe 40 at a single point on the lower side of the flat pipe 40.

The partition member 67 has arrangement fixing portions 81, 82 at a surface opposite to a surface having two protruding portions 68, 69 contacting the tip end of each flat pipe 40. The arrangement fixing portions 81, 82 extend from the upper closing member 63 to the lower closing member 64, and contact an inner surface of the tubular member 62. Two arrangement fixing portions 81, 82 reduce rotation of the partition member 67 along the inner surface of the tubular member 62. With this configuration, arrangement of the partition member 67 can be fixed. Note that as long as arrangement can be fixed, two arrangement fixing portions are not necessarily provided. Only a single arrangement fixing portion may be provided. Moreover, as long as arrangement can be fixed, the arrangement fixing portions 81, 82 do not necessarily extend from the closing member 63 to the closing member 64.

Moreover, the partition member 67 includes a protrusion 83. The protrusion 83 contacts, between two arrangement fixing portions 81, 82, a tip end of a refrigerant supply pipe 44 inserted into the supply port 61. In the case of inserting the supply pipe 44 into the supply port 61, the degree of such insertion might be unclear. Moreover, when the tip end of the supply pipe 44 contacts the partition member 67, the refrigerant supply port is closed. For this reason, no refrigerant can be supplied. The protrusion 83 is provided at the partition member 67, and therefore, positioning of the supply pipe 44 in an insertion direction thereof is stabilized.

The partition member 67 includes the multiple protrusions 80 and the protrusion 83. Thus, positioning of each flat pipe 40 and the supply pipe 44 is facilitated. Note that only the multiple protrusions 80 may be provided as protrusions. Alternatively, only the protrusion 83 may be provided. Moreover, the number of protrusions is not limited to a single protrusion for each flat pipe 40 or the supply pipe 44. Two or more protrusions may be provided. Note that in a case where the number of protrusions increases, the refrigerant flow path is closed by the protrusions. Thus, the number of protrusions is preferably a single protrusion for each flat pipe 40 or the supply pipe 44.

Figure 8A:
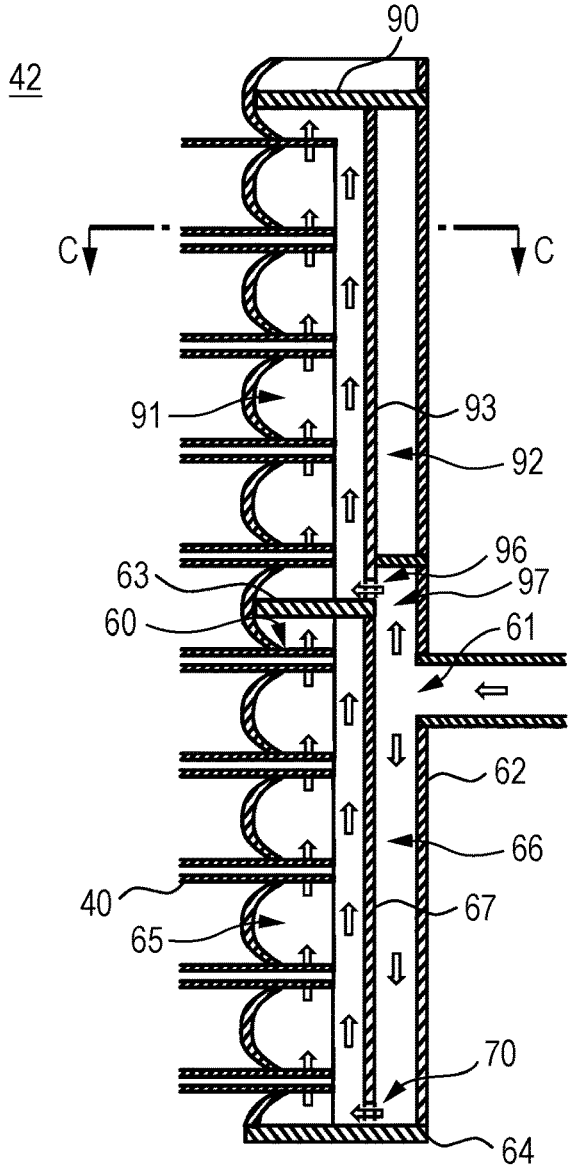
FIGS. 8A and 8B are views of a third example of the distributor provided at the heat exchanger.
Figure 8B:
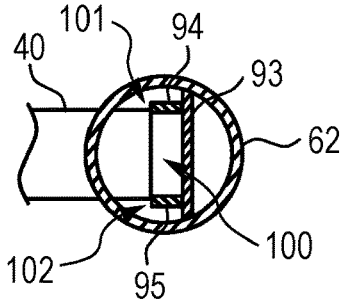

FIGS. 8A and 8B are views of a third configuration example of the header. FIG. 8A is a sectional view of the header in the longitudinal direction thereof. FIG. 8B is a sectional view in a C-C direction of a cut line of FIG. 8A. The header 42 includes the tubular member 62 and the closing members 63, 64. The tubular member 62 includes the multiple insertion ports 60 and the supply port 61. The closing members 63, 64 close the tubular member 62 at two spots positioned along the longitudinal direction of the tubular member 62.

The header 42 includes a closing member (a third closing member) 90 closing one end of the tubular member 62 in the longitudinal direction thereof. Moreover, the header 42 includes a partition member (a second partition member) 93. The second partition member divides a space closed by the closing member 63 and the closing member 90 into a space 91 on the side of the multiple insertion ports 60 and a space 92 on the supply port 61 side. The partition member 93 includes two protruding portions (second protruding portions) 94, 95. The second protruding portions 94, 95 contact the tip ends of the multiple flat pipes 40 inserted into the multiple insertion ports 60. Moreover, the partition member 93 has a passage (a third passage) 96 between two protruding portions 94, 95 on the lower side (a closing member 63 side) of the lowermost insertion port 60. The closing member 63 has a passage (a second passage) 97 in which the refrigerant flows. The space 92 is closed on the lower side.

The inflow refrigerant through the supply port 61 is branched into refrigerant flowing downward in the space 66 and refrigerant flowing toward the upper space 91 through the passages 97, 96. The refrigerant supplied to the space 66 has been already described with reference to FIGS. 6A and 6B. Thus, further description will be omitted here.

The refrigerant supplied to the space 91 enters the space 91 through the passage 96, and flows in three flow paths from the lower side to the upper side. As in the example illustrated in FIGS. 6A and 6B, three flow paths are a first flow path, a second flow path, and a third flow path. The first flow path 100 is defined by the partition member 93, two protruding portions 94, 95, and the tip ends of the flat pipes 40. The first flow path 100 includes a region continuing from the lower closing member 63 to the upper closing member 90. The second flow path 101 is defined by the tubular member 62, the side portions of the flat pipes 40, and the protruding portion 94. The second flow path 101 includes a region continuing from the lower closing member 63 to the upper closing member 90. The third flow path 102 is defined by the tubular member 62, the side portions of the flat pipes 40, and the protruding portion 95. The third flow path 102 includes a region continuing from the lower closing member 63 to the upper closing member 90.

In this case, the sectional area of the first flow path 100 can be larger than the total of the sectional area of the second flow path 101 and the sectional area of the third flow path 102. With this configuration, the refrigerant flow velocity is high in the second flow path 101 and the third flow path 102. Thus, the refrigerant in the gas-liquid two-phase state flows in the second flow path 101 and the third flow path 102. Accordingly, the refrigerant in the gas-liquid two-phase state can be supplied to the first flow path 100 from both of the upper and lower sides. As a result, the refrigerant in the gas-liquid two-phase state equally flows in any flat pipe 40. Consequently, the refrigerant drift can be improved.

In this case, the supply port 61 is, on the upper side, preferably provided at a position as close as possible to the passage 97 such that the refrigerant is also properly supplied to the space 91.

In an example illustrated in FIGS. 8A and 8B, no protrusions 80, 83 illustrated in FIGS. 7A and 7B are provided. Note that one or both of the protrusions 80, 83 may be provided.

As described above, the closing member 90 can be further added to the tubular member 62 in a direction of extension thereof, and the partition member 93 can be further added to the inside of the extended tubular member 62. With this configuration, even in a case where the number of flat pipes 40 increases, the refrigerant can be substantially equally distributed to each flat pipe 40 by the single header 42. Since only the closing member and the partition member need to be added, a material cost can be reduced.

Figures 9, 10:
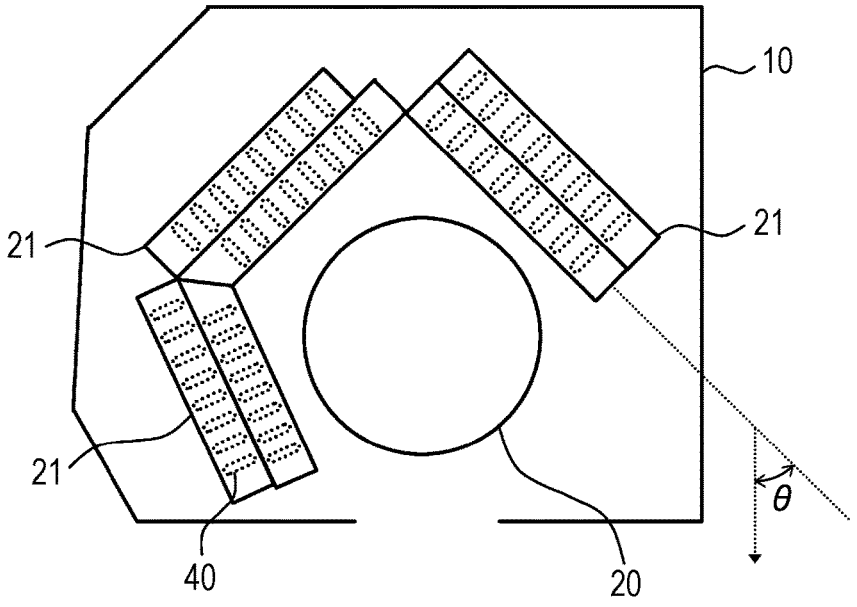
FIG. 9 is a view of one example of arrangement of the heat exchangers in the indoor unit.
FIG. 10 is a table showing refrigerant drift test results.

FIG. 9 is a view of an arrangement example of the heat exchanger 21 applied to the indoor unit 10. The heat exchanger 21 described here includes the header 42 described as an example with reference to FIGS. 6A to 8B. The indoor unit 10 has the fan 20. The heat exchanger 21 is arranged to surround the fan 20.

In an example illustrated in FIG. 9, three groups of heat exchangers 21 are arranged. A single group of heat exchangers 21 described here includes two heat exchangers arranged in two tiers. The heat exchangers are arranged such that an angle θ between the header axis of the header of each heat exchanger 21 and the direction of the force of gravity as indicated by an arrow is an angle within 45 degrees.

This is because water droplets caused by moisture contained in air and condensed on an outer surface of the heat exchanger 21 flow downward along the outer surface of the heat exchanger 21 in such arrangement. As a result, dropping of the water droplets onto the fan 20 can be reduced.

Note that the number of tiers of the heat exchangers included in the single group of heat exchangers 21 is not limited to two tiers. The number of tiers may be a single tier or three or more tiers.

A drift rate Dr can be, as an indicator of the drift, defined by Expression 1 below. In this expression, σL is the standard deviation of the length of the refrigerant in the gas-liquid two-phase state in each flat pipe 40 (the length of the black portion 55 in FIG. 5). Lave is the average of the length of the refrigerant in the gas-liquid two-phase state in each flat pipe 40. A smaller value of the drift rate Dr indicates more equal distribution of the refrigerant.

[Expression 1]

$$D_r = \frac{\sigma L}{L_{ave}} \quad \text{(Expression 1)}$$

FIG. 10 is a table of test results for comparing the drift rate. In a test, a header (without a partition member) having a typical cavity and a header (with a partition member) including the partition member 67 illustrated in FIGS. 6A and 6B were used. R32 (hydrofluorocarbon) as the refrigerant was supplied to the header at two flow rates of 10 kg/h and 5 kg/h. Moreover, the test was performed under a condition where the degree of dryness at a refrigerant inlet is about 0.7, the degree of superheat of the refrigerant at an outlet is 5 degrees, and an air-side inlet temperature is 27 degrees. The degree of dryness is the weight percentage of gas in the gas-liquid two-phase state. When the header is saturated with vapor, the degree of dryness is 1. When the header has only liquid, the degree of dryness is 0. The superheat degree is a value indicating the temperature degree increased from a saturated temperature. Two tests for different flow rates were performed twice under each condition with and without the partition member.

As illustrated in FIG. 10, the test results show that the drift rate is high in the case of the typical distributor without the partition member. In the case of the present distributor with the partition member, the drift rate is low. Thus, it has been confirmed that the drift is improved by the partition member. Moreover, assuming that a flow rate of 10 kg/h is the rated load condition and a flow rate of 5 kg/h is the intermediate load condition, the drift rate increases when the load decreases in the typical case without the partition member. On the other hand, in the case of the present distributor, even when the load decreases, almost no change is made in the drift rate. Thus, it has been confirmed that the refrigerant can be also substantially equally distributed to each flat pipe 40 in operation with different loads.

With the present distributor, an uneven amount of liquid refrigerant supplied to each flat pipe 40 in the parallel flow type heat exchanger can be reduced by a simple structure even in operation under the intermediate load condition or the minimum load condition. Thus, performance as the heat exchanger 21 can be improved. Further, power consumption of the air-conditioning device including the indoor unit or the outdoor unit having the heat exchanger 21 can be reduced.

The distributor, the heat exchanger, the indoor unit, the outdoor unit, and the air-conditioning device according to the present embodiment have been described so far in detail with reference to the above-described embodiment. Note that the present embodiment is not limited to the above-described embodiment. By, e.g., addition, change, and deletion of elements, the above-described embodiment can be changed to other embodiments within a scope which can be arrived by those skilled in the art. As long as the features and advantageous effects of the present embodiment are provided, any aspect is included in the technical scope of the present embodiment.

What is claimed is:

1. A distributor for distributing refrigerant to multiple pipes, comprising:

a tubular member including multiple insertion ports into which the multiple pipes are inserted and a single supply port disposed in a side of the tubular member through which the refrigerant is supplied;

a first closing member, which is a top enclosure of the tubular member and a second closing member, which is a bottom enclosure of the tubular member, respectively configured to close the tubular member at a top position and a bottom position thereof, which are opposed to each other in a longitudinal direction of the tubular member; and a partition member extending longitudinally from the first closing member to the second closing member and configured to divide an internal space of the tubular member into a first space on a side of the tubular member having the multiple insertion ports and a second space on a side of the tubular member having the supply port, wherein the first space and the second space are devoid of partitions parallel to the two closing members of the tubular member, wherein the partition member includes two protruding portions contacting respective tip ends of each of the multiple pipes inserted into the multiple insertion ports, and includes a refrigerant flow path between the two protruding portions that contact respective tip ends of a pipe, of the multiple pipes, disposed closest to the first closing member, wherein the partition member is entirely disposed between the first closing member and the second closing member, and wherein the single supply port is disposed closer to the second closing member than the first closing member.

2. The distributor according to claim 1, wherein in the first space, a first flow path is defined by the partition member including the two protruding portions and the multiple inserted pipes, and a second flow path and a third flow path are further defined by the tubular member and the multiple inserted pipes, and wherein a sectional area of the first flow path is larger than a total of a sectional area of the second flow path and a sectional area of the third flow path.

3. The distributor according to claim 1, wherein the partition member includes multiple protrusions protruding from a surface of the partition member that the two protruding portions protrude, each of the multiple protrusions respectively contacting a pipe of the multiple pipes.

4. The distributor according to claim 1, wherein the partition member includes, on a side opposite to the surface from which the two protruding portions protrude, an arrangement fixing portion, which includes two protrusions contacting an inner surface of the tubular member.

5. The distributor according to claim 1, further comprising:

a third closing member disposed between the first closing member and the second closing member; and a second partition member extending from the third closing member to the second closing member in the longitudinal direction and configured to divide the internal space of the tubular member into a first space on a side of the tubular member having the multiple insertion ports and a second space on a side of the tubular member having the supply port wherein the second closing member includes a second refrigerant flow path, and wherein the second partition member includes two second protruding portions extending from the third closing member to the second closing member and contacting respective tip ends of the multiple pipes inserted into the multiple insertion ports, and includes a third refrigerant flow path between the two second protruding portions that contact respective tip ends of a pipe, of the multiple pipes, disposed closest to the third closing member.

6. A heat exchanger comprising:

the distributor according to claim 1.

7. An indoor unit comprising the heat exchanger according to claim 6.

8. The indoor unit according to claim 7, further comprising an air blowing section, wherein multiple heat exchangers, including the heat exchanger, are arranged to surround the air blowing section, and an angle between a longitudinal direction of the distributor of the heat exchanger and a direction of gravitational force is within 45 degrees.

9. An outdoor unit comprising the heat exchanger according to claim 6.

10. An air-conditioning device comprising at least one of indoor and outdoor units comprising the heat exchanger according to claim 6.

* * * * *